United States Patent [19]

Weston

[11] 4,196,758

[45] Apr. 8, 1980

[54] APPARATUS FOR TESTING THE AUTOMATICALLY OPERATING CONTROL OF A PUMP

[76] Inventor: William A. Weston, "The Barn" Portkil Bay, Kilcreggan, Helensburgh, Dunbartonshire, England

[21] Appl. No.: 942,887

[22] Filed: Sep. 14, 1978

[30] Foreign Application Priority Data

Sep. 14, 1977 [GB] United Kingdom ..... 38307/77

[51] Int. Cl.[2] ..... B63B 13/00; B65B 3/26

[52] U.S. Cl. ..... 141/83; 73/168; 114/183 R; 141/98; 417/63

[58] Field of Search ..... 73/168; 114/183 R, 184; 137/527.8; 141/1, 18, 98, 392, 83; 417/40, 63

[56] References Cited

U.S. PATENT DOCUMENTS

| | | | |
|---|---|---|---|
| 677,277 | 6/1901 | Rodgers et al. | 114/183 R |
| 2,612,777 | 10/1952 | Greer | 73/168 |
| 3,937,168 | 2/1976 | Doak | 137/527.8 X |
| 4,050,396 | 9/1977 | Ridgeway | 417/40 X |

*Primary Examiner*—Frederick R. Schmidt

*Attorney, Agent, or Firm*—Mason, Fenwick & Lawrence

[57] ABSTRACT

A control device for automatically operating a bilge pump is located in a receptacle having, in its side wall, holes at a level below the predetermined level of liquid at which the control device is designed to start the pump automatically, and having an inlet through which liquid can be introduced into the receptacle at a greater rate than it can flow out through the holes, so that the liquid can rise to said predetermined level to effect testing of the control device and the pump.

6 Claims, 3 Drawing Figures

APPARATUS FOR TESTING THE AUTOMATICALLY OPERATING CONTROL OF A PUMP

Figure 1:
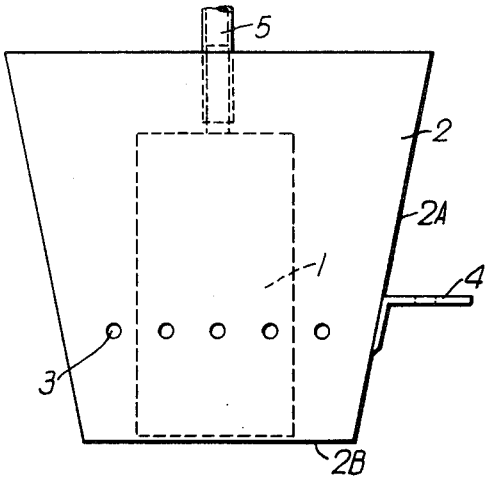

This invention relates to pumps, especially, but not exclusively, bilge pumps, of the kind having an automatically-operating control device. Such a device may be incorporated in the pump during manufacture and form an integral part thereof, or it may be manufactured separately as an accessory for subsequent connection to the pump. Also, such a device incorporates a sensor which is responsive to predetermined variations in water levels, so that the pump is switched-on automatically, if the water rises to an undesired predetermined level, and switches-off when the water falls to an acceptable predetermined level. The sensor may, for example, be a pressure switch.

It will now be assumed, for convenience of description, that the pump is a bilge pump in a boat, though the pump is suitable for other uses.

Automatically controlled bilge pumps of the kind aforesaid are of considerable benefit to boat owners, as a boat can be left unattended, and, if, for example, a leak in the hull or heavy rain increases the water level in the bilges to a predetermined level then the bilge pump should switch-on and pump the bilges to a lower predetermined level and then switch-off. Such action should continue indefinitely keeping the height of water in the bilges to a pre-arranged and safe level. Under normal circumstances, when there are no leaks in the hull and no heavy rain to increase bilge water levels, the automatic pump is not brought into action, and the owner or user of the boat normally manually switches-on the bilge pump when he returns after a period away from the boat to pump out any excess water in the bilges, the water not having reached a height sufficient to activate the automatic control device of the pump.

From the foregoing, it is easily seen that although an automatically controlled bilge pump is fitted to a boat or yacht it is most unlikely that it will, under normal circumstances, be brought into action. There is therefore always a doubt in the owner's mind that the bilge pump will operate automatically, should it be needed. A method of quickly and easily testing the automatic control device and the pump is therefore highly desirable.

At present, there is no way of doing this, short of flooding the bilges to the height at which the automatic pump will be activated, or, getting down into the bilges and, when the automatic control device is a separate unit from the pump, removing it, and physically pressurising the mechanism to activate the switch; or, if the control device is a part of the pump, removing the whole pump, or at least part of it, to physically activate the switch. Even these methods of testing do not conclusively prove that a rise in the height of the bilge water will certainly activate the pump. It will be appreciated that many boat users or yachtsmen do not have the ability or knowledge to carry out these tests, and flooding the bilges could be dangerous especially if the pump proved, after such test, to be faulty.

An object of the present invention is to obviate this disadvantage and to relieve the owner of worry as to whether or not his bilge pump will operate automatically in an emergency, by providing simple and inexpensive apparatus by which one can check easily and quickly whether or not the pump will operate automatically under the conditions in which it will be required to work should the circumstances arise.

According to the present invention there is provided, in combination, an automatically operating control device for a pump, said device being an accessory for the pump, and a receptacle in which said device is located, said receptacle having in its side wall aperture means at a level below the predetermined level of liquid at which the control device is designed to switch-off the pump automatically, and having an inlet through which liquid can be poured into the receptacle at a greater rate than it can flow out through the aperture means, so that liquid poured into the receptacle can rise in the receptacle to the predetermined level at which the control device is designed to switch-on the pump, to effect testing of the control device and the pump when the device is connected to the pump.

Further, according to the present invention there is provided, in combination, a pump incorporating an automatically operating control device and a receptacle in which the pump is located, said receptacle having in itsside wall aperture means at a level below the level of liquid at which the automatic control device of the pump is designed to switch-off the pump automatically, and, having an inlet through which liquid can be introduced into the receptacle to a greater rate than it can flow out through the aperture means, so that the liquid can rise in the receptacle to the predetermined level at which the control device is designed to switch-on the pump, to effect testing of the control device and the pump, and the side wall also having at least one inwardly opening non-return valve below said first-mentioned level.

Preferably, said aperture means consists of a plurality of holes peripherally spaced around the receptacle.

Preferably, also, when the pump is a bilge pump for a boat, said aperture means is below the normal bilge water level.

Preferably also, when the pump incorporates said control device, there is a plurality of inwardly-opening non-return valves peripherally spaced around the receptacle.

Preferably also, when the pump is a bilge pump for a boat, said non-return valve or valves is or are located below the normal bilge water level.

A refillable liquid container for supplying liquid to the receptacle to effect testing may be provided, and may be located at a station remote from the receptacle and pump, and be connected to the receptacle by a pipe or tube.

Figure 3:
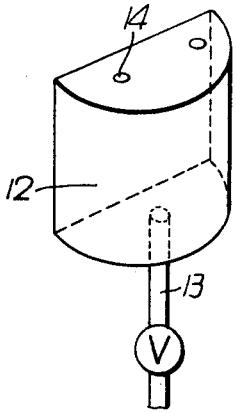
Figure 2:
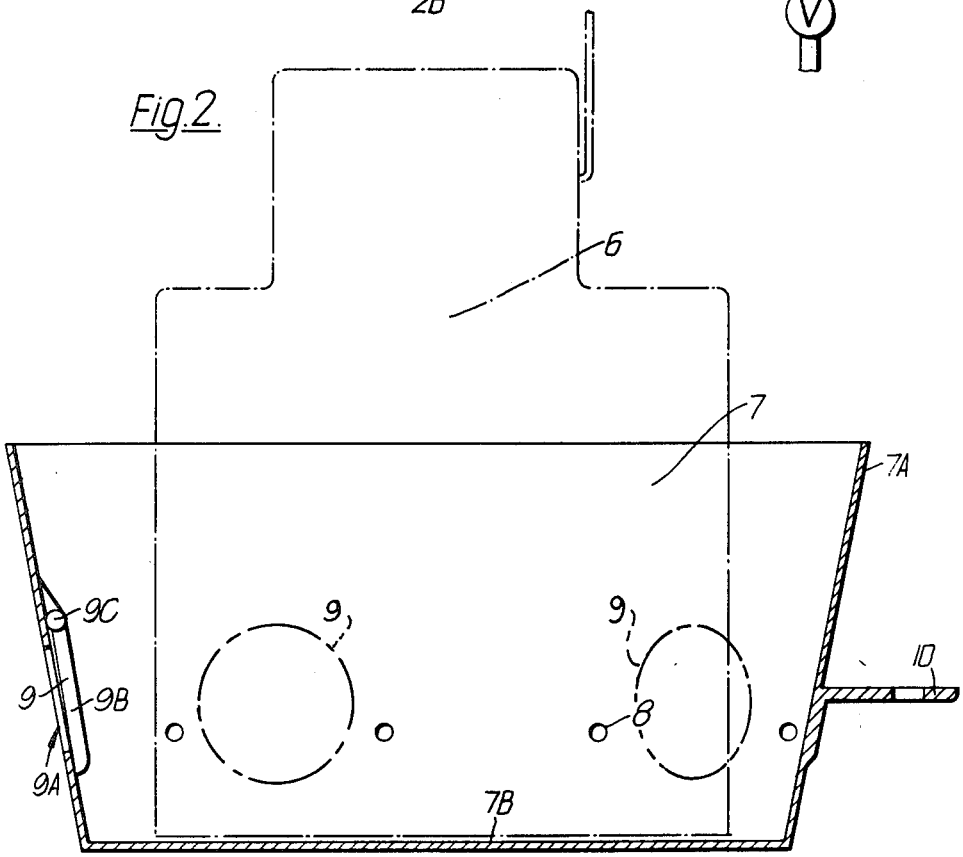

An embodiment of the invention will now be described, by way of example, with reference to the accompanying diagrammatic drawing, in which:

FIG. 1 is a side view of a testing apparatus according to the present invention in use with an automatic control device which is an accessory external to the pump, FIG. 2 is a sectional view corresponding to FIG. 1, and showing the testing apparatus in use with a pump incorporating an automatic control device, and FIG. 3 is a perspective view of an optional part of the testing apparatus.

Referring to FIG. 1, a bilge pump, not shown, has a separate automatic control device 1 which is normally fixed at a suitable place in the bilges of a boat.

According to the present embodiment of the invention, the device 1 is placed and fixed within an upstanding opentopped receptacle 2 which has a side wall or walls 2A which may be inclined as shown or vertical, and may, in plan view, be round, oval, square or oblong, or as otherwise required to facilitate filling it with liquid, and which has a bottom wall 2B but no top wall. On the wall 2A of the receptacle 2 there is a plurality of peripherally spaced holes 3 which are located at a height that is below the water level at which the control device is designed to switch-off the pump automatically, and is below the normal "low water" level of the water in the bilges. The holes 3 are sufficient in size and in number to allow the bilge water to enter and leave the receptacle as the height of the water in the bilges rises and falls. The receptacle 2 is fixed in the bilges at a suitable place, and the control device 1 is connected to the pressure sensitive switch for the pump by a pipe 5.

In order to test the automatic control device 1 and the pump itself, water is poured manually into the receptacle 2 in sufficient quantity to raise the level of the water in the container to a height necessary to activate the switch of the control device, and in so doing activate the pump.

The lower end of the device 1 is open and spaced above the bottom wall 2B of the receptacle 2 to permit the inlet of water from the receptacle 2, so that, when the water rises to said necessary level, the pressure of air in the tube 5 increases sufficiently to actuate the pressure switch.

The water then slowly drains out through the holes 3, and, when the level of the water in the container and the bilges is at a previously arranged predetermined level as set by the pump manufacturers, the pump automatically switches itself off.

In a modification, a switch, which may be a float-operated switch, is located in the device 1, and is electrically connected to the pump switch.

The pump and automatic control device can thus be tested under conditions similar to that which would occur should it be brought into service in an emergency. Referring to FIG. 2, a bilge pump 6 which has its automatic control device embodied in the pump is normally fitted in a suitable place in the bilges.

According to the present embodiment of the invention, the bilge pump 6 is placed and fixed inside a receptacle 7. The latter is similar to the receptacle 2, FIG. 1, and has a side wall or walls 7A, a bottom wall 7B and a plurality of holes 8.

The receptacle 7 is fixed in the bilges at a suitable place, and testing of the bilge pump and its automatic control device is carried out in the same manner as described with reference to FIG. 1.

The receptacle 7 also has a plurality of inwardly opening non-return valves 9 on its side wall below the normal low water level in the bilges. The valves 9 are relatively large compared to the holes 8 and are of sufficient size to allow a full flow of water from the bilges to the pump when it is in action.

Each valve 9 consists of an aperture 9A in the wall 7A of the receptacle, and a flap 9B. The wall 7A is downwardly and inwardly inclined, and the flap 9B is correspondingly inclined and is suspended from a pivot 9C on the wall 7A. The flap 9B therefore normally adopts its closed position by gravity and rests against the inclined wall 7A or a seat thereon.

The valves 9 are spaced around the receptacle 8 in sufficient number, so that, should the boat heel over sufficiently to keep the valves on one side shut by gravity, the valves on the opposite side will open and be sufficient in number and size to allow a full flow to the bilge pump. Other forms of inwardly opening non-return valves may be used.

FIG. 3 shows a remote control device which may be used in conjunction with the testing apparatus described with reference to FIGS. 1 and 2. The remote control device consists of a container 12 which may be open or closed at the top, and which is of sufficient size to hold enough water to raise the water level in the receptacle 2 or 7 to a height at which the automatic control device of the pump operates.

Attached to the bottom of container 12, there is a pipe 13 of sufficient bore to allow the water in the container to be swiftly gravity fed to the receptacle 2 or 7.

A tap, not shown may be fitted to the container 12 or to the pipe 13 in order that water can be stored in the container and be released when required.

Lugs 4, FIG. 1, and 10, FIG. 2, may be provided on the receptacles 2 and 7 for use in fixing the receptacles in position in the bilges. Lines or other marks, not shown, extending around the containers 2 and 7 may be provided to show the normal bilge level and the level at which the automatic control device should activate the pump, and a line or mark around the container 12 may be used to show the height to which the container should be filled.

A clip or other holder, not shown, may be provided on each receptacle 2, 7, to retain the pipe 13 in place.

Should, for any reason, the manual switch for the pump become inoperable, faulty, or unreachable, the automatic control device can be activated by the test apparatus, thus giving two positions on the boat at which the pump can be activated. This could be vital in the case of an emergency, as the pump could be brought into action before the water level in the bilges reached the pump manufacturer's predetermined high level.

In FIG. 3, the numeral 14 indicates holes in the rear wall of the container 12, by means of which the latter can be secured by nails or hooks to a fixture.

As aforesaid, the testing apparatus may be used with automatically controlled pumps, other than bilge pumps.

What I claim is:

1. In combination, a pump incorporating an automatically operating control device, and a receptacle in which the pump is located, said receptacle having in its side wall aperture means at a level below the level of liquid at which the automatic control device of the pump is designed to switch-off the pump automatically, and, having an inlet through which liquid can be poured into the receptacle at a greater rate than it can flow out through the aperture means, so that the liquid poured into the receptacle can rise to the predetermined level at which the control device is designed to switch-on the pump, to effect testing of the control device and the pump, and the side wall also having at least one inwardly opening non-return valve below said first mentioned level to allow a full flow of water to the pump and automatic control device.

2. The combination claimed in claim 1, in which said aperture means consists of a plurality of holes peripherally spaced around the receptacle.

3. The combination claimed in claim 1, in which the receptacle is provided with a plurality of inwardly-opening non-return valves spaced around same.

4. The combination claimed in claim 3, in which said valves are flap valves, of which the flaps are pivotally suspended and the seats and flaps are inclined downwardly and inwardly, so that the flaps gravitate to their closed positions.

5. The combination claimed in claim 3 or 4, in which the valves are so spaced around the receptacle and are in such number and of such size that, when the combination is located in the bilges of a boat, at least one valve can open to maintain an adequate supply of water to the pump, irrespective of the attitude of the boat.

6. The combination claimed in claim 1, in which there is provided a refillable container for water, the container having a pipe or tube leading to said receptacle, and a cock or valve is provided so that water may be stored in the container and be released when required.

* * * * *